US006743323B2

(12) United States Patent
Mainetti

(10) Patent No.: US 6,743,323 B2
(45) Date of Patent: Jun. 1, 2004

(54) METHOD OF MAKING A LEVER DEVICE FOR CLAMPS OF A GARMENT HANGER

(75) Inventor: Mario Mainetti, Valdagno (IT)

(73) Assignee: Mainetti Tecnologie S.p.A., Castelgomberto (IT)

( * ) Notice: Subject to any disclaimer, the term of this patent is extended or adjusted under 35 U.S.C. 154(b) by 128 days.

(21) Appl. No.: 10/016,354

(22) Filed: Oct. 29, 2001

(65) Prior Publication Data

US 2002/0060231 A1 May 23, 2002

(30) Foreign Application Priority Data

Nov. 22, 2000 (IT) ..... VI2000A0258

(51) Int. Cl.[7] ..... A47G 25/48

(52) U.S. Cl. ..... 156/251; 156/290; 156/308.4; 223/93; 223/96; 223/98

(58) Field of Search ..... 140/81.5; 223/93, 223/96, 98; 156/291, 251, 308.4

(56) References Cited

U.S. PATENT DOCUMENTS 5,269,872 A * 12/1993 Ueda ..... 156/515
5,398,854 A * 3/1995 Blanchard ..... 223/96
6,009,925 A * 1/2000 Hall et al. ..... 156/358

* cited by examiner

*Primary Examiner*—Jeff H. Aftergut
*Assistant Examiner*—Barbara J Musser
(74) *Attorney, Agent, or Firm*—Bucknam and Archer

(57) ABSTRACT

There is provided an improved lever device for clamps of a garment-hanger, wherein the interior section, which press on the fabric the hung cloth, is coated by a strip of soft material, which is joined to the undersurface by means of a peripheral welding cord which is placed substantially along the external profile of the welded strip.

2 Claims, 3 Drawing Sheets

METHOD OF MAKING A LEVER DEVICE FOR CLAMPS OF A GARMENT HANGER

BACKGROUND OF THE INVENTION

The present invention relates to an improved lever device for clamps of a garment-hanger.

Garment-hangers of the so called type "with clamps" are already known and they include a rod with a hook and with two freely placed clamps in order to hold the hung cloth. Both of these two clamps include a couple of lever devices of the first order, pivoted on the rod and reciprocally joined and pre-loaded one against the other, in close configuration, by means of a pre-loaded "U" spring. Each lever device includes a first portion pressing on the fabric of the hung cloth (in opposition to the corresponding first portion of the other lever device of the pliers) and a second portion, on which the user's fingers act, during the opening of the clamp, acting against the spring power. On the inside of the first portion the surface pressing directly on the hung garment has special anti-slip features, in order to sustain the hold on the fabric.

At the present state of the art, different constructional solutions are known to be suitable for this purpose, comprising the application of a layer of soft rubber by molding or the use of removable tags embedded in the body of the lever device. All the known solutions have the drawback that they need complicated machines to realize the molding of the rubber on the lever device or to manufacture the tag, which, later, has to be placed on said element, which increases the final cost, which should be as low as possible, if we consider the kind of product.

BRIEF SUMMARY OF THE INVENTION

An object of the present invention is to realize a completely automatic and inexpensive process to cover the inside part, that which is in touch with the fabric, of the lever device of a garment-hanger.

This object is achieved by providing strips of soft material, originally wound in a coil, which are at first placed, by means of a steady step movement, above the surface to be covered and, then, cut in sections, which are then joined to the surface below.

A first feature of the present invention is represented by the use of soft plastic materials such as, for example, polyurethane, neoprene, polyethylene and similar materials, which are not expensive and, up to now, have been used only to cover the rod and/or the ends of the arch structure of the rod garment-hangers. Velvet material can also be used.

A further feature of the present invention is represented by the fact that the welding of the strip sections on the surface of the lever device is achieved by means of a welding head, which carries out a linear welding connected only with the borders of said section, in such a way that part of the section, which is inside the welding cord, remains sufficiently soft, so as to raise the "sponge" effect, which is typical of the material used.

A further feature of the present invention is represented by the fact that the welding, carried out by means of a welding resistance or laser head, is of the type called "in hot inclusion", which realizes only the fusion of the plastic support, represented by the lever device incorporating the material of the strip, which, with a higher melting-point, remains integral.

BRIEF DESCRIPTION OF THE DRAWINGS

Further features of the present invention are more clearly shown by reference to the more detailed description, which is provided for the purpose of illustration and which is not intended to be limiting, of the steps of the process and of a possible embodiment of the lever device, by reference to the accompanying drawings, of which.

DETAILED DESCRIPTION OF THE INVENTION

Figure 1:
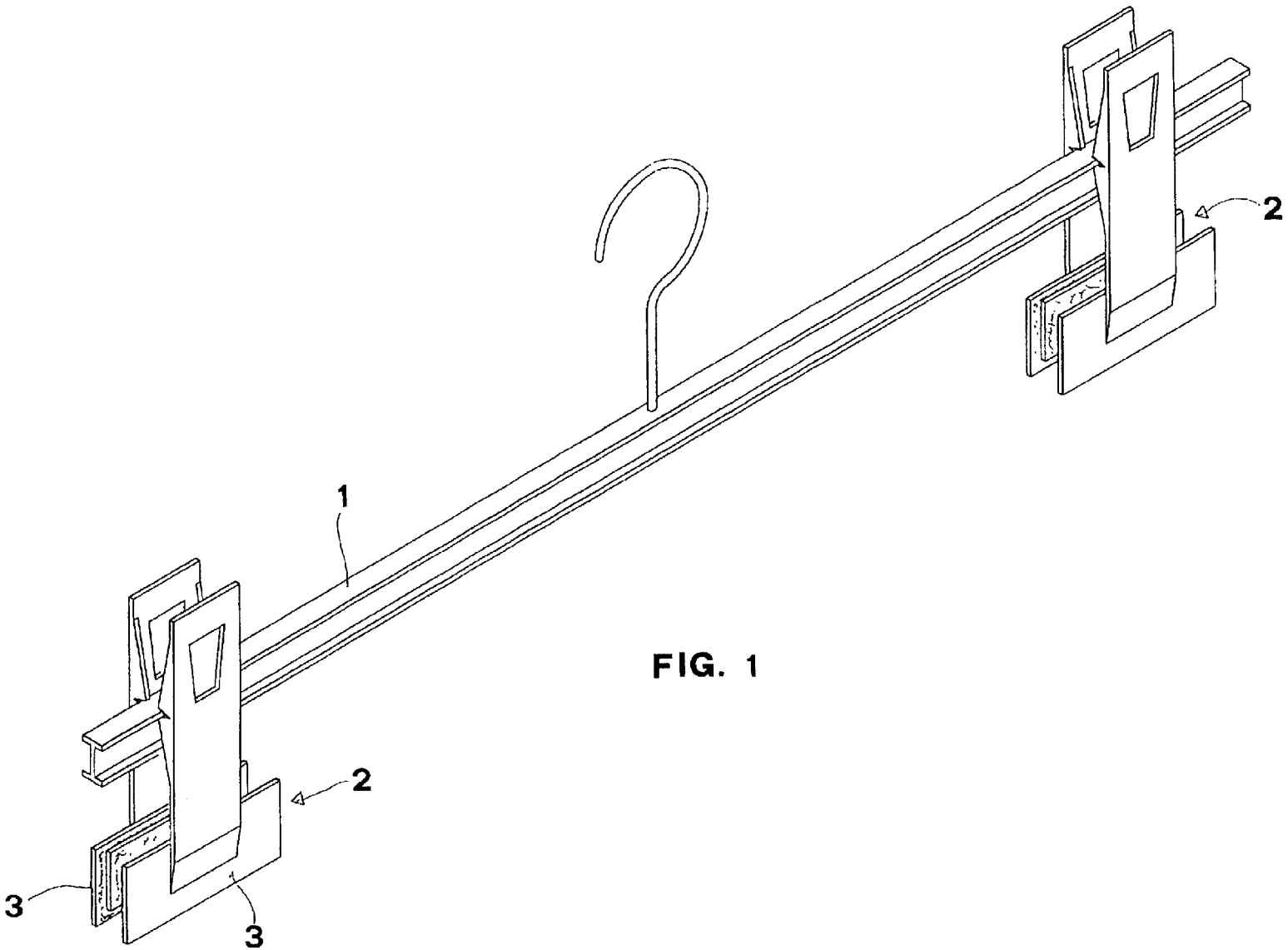
FIG. 1 is a perspective view of a garment-hanger with the lever devices of the present invention.

As shown in FIG. 1, the garment-hanger of the type called "with clamps" comprises a rod 1, with a hook, on which the two clamps 2, which hold the garment, are placed. Each clamp 2 comprises a pair of lever devices 3 of the first order, pivoted on the rod and reciprocally joined and pre-loaded one against the other, in close configuration, by means of a pre-loaded "U" spring (not shown). Each lever device 3 is divided into a first portion 4 pressing on the fabric of the hung garment (in opposition to the corresponding first portion of the other lever device of the clamp) and into a second portion 5, on which the user's fingers act during the opening of the clamp, acting against the spring tension.

Figure 3:
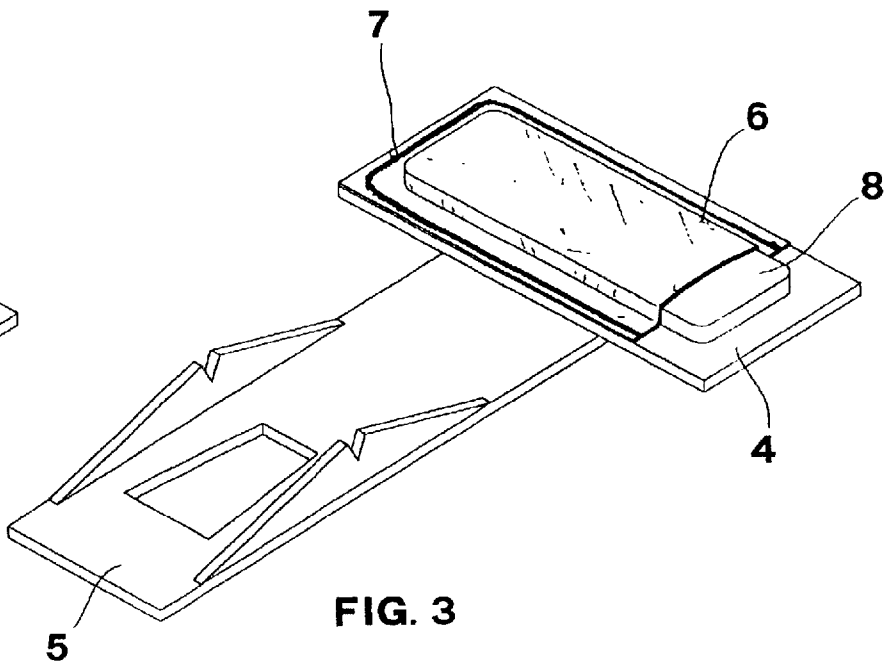
FIG. 3 is a perspective view of the lever of FIG. 2 showing the strip of soft material placed thereon.
Figure 2:
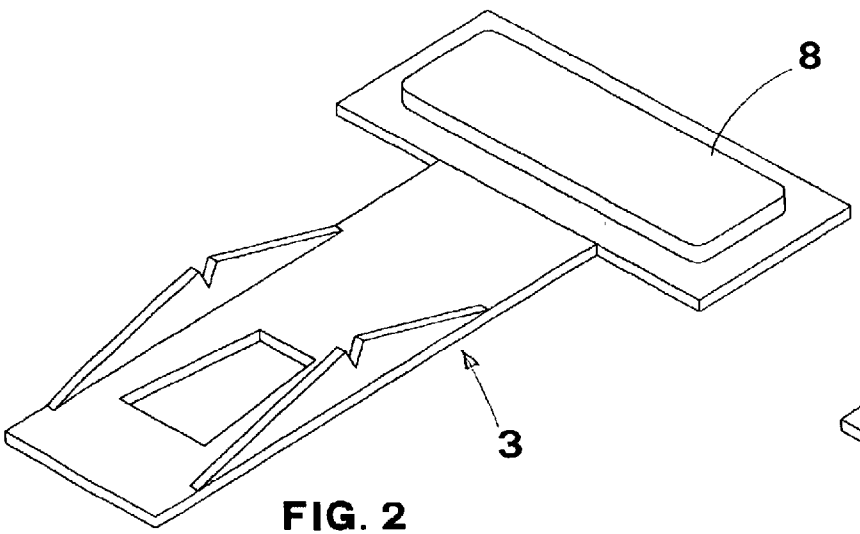
FIG. 2 is a perspective view of a lever device of the invention.
Figure 4:
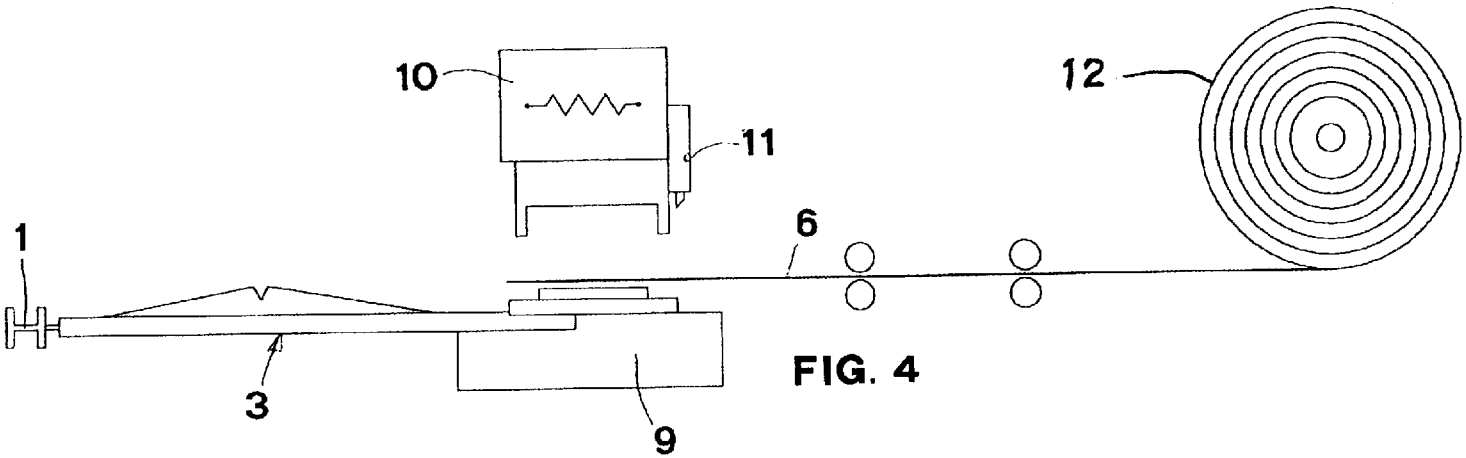
FIG. 4 is a schematic elevational view of the plant of the present invention.

As shown in FIGS. 2 and 3, the inside part of the first portion 4 is covered by a strip 6 of plastic material, which is joined to the below support by means of a welding peripheral cord 7 which is placed substantially along the external profile of said weling strip. The portion 4, corresponding with the above strip 6, comprises a step 8, which allows to keep in a low position the welding cord 7, with reference to the contact zone of the hung garment and, moreover, to make softer the central zone of said strip 6.

Figure 5:
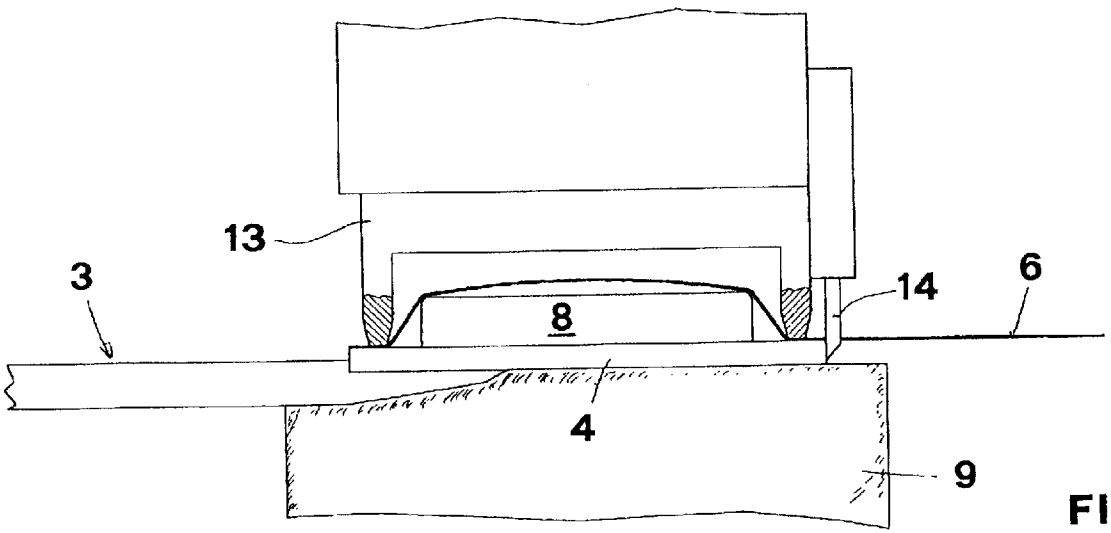
FIG. 5 is a schematic view of the working step of the process of the present invention.

As shown in FIG. 5, the strip 6 is placed, by means of known pulling devices (not shown), connected with the portion 4 and namely above the step B. Afterwards the welding head 10 is lowered and by means of the shaped electrode 13, at first, shapes the strips 6 on the step 8 and then realizes the peripheral welding cord 7.

Finally the lowering of the blade 14, projecting from the cutting group, divides the portion of the strip from the remaining band.

In order to make the process more productive it is possible to carry out the working described above simultaneously on more lever devices 3, placed in series; for example on the four elements which form the two clamps and which are molded together with the rod 1, which acts as support for the same.

What is claimed is:

1. A process for the production of clamps of a clamp-type garment hanger wherein each clamp includes an opposing pair of lever devices (3), each lever device includes a plastic first portion (4) biased in opposition to a corresponding first portion of the opposing lever device of the clamp and contacting the fabric of the garment hung therebetween, and a second portion (5) forming the operative portion of the lever device, the process comprising:

supporting said first portion (4) of said lever device on a base support (9);

covering the contact surface of said first portion (4) on which a step (8) is present with a strip (6) of soft plastic material from a wound coil thereof;

engaging the contact surface of said first portion (4) covered by said strip (6) of soft plastic material with a welding head (10) having a shaped electrode (13) which shapes the strip (6) on the step (8) of said first portion (4);

welding said strip (6) to the contact surface of said first portion (4) with said shaped electrode (13) along a periphery of said first portion (4) by the fusion only of the material of said first portion and incorporating therein the material of said strip, which has a higher melting point and therefore remains integral, thereby forming a welding cord (7) disposed below said step (8); and separating by cutting the strip (6) welded onto the first portion (4) from the wound coil thereof.

2. The process for the production of clamps of a clamp-type garment hanger as defined in claim 1, wherein the material of said strip (6) is polyurethane, neoprene or polyethylene.

* * * * *